United States Patent [19]

Juvet

[11] Patent Number: 4,584,799

[45] Date of Patent: Apr. 29, 1986

[54] METHOD OF FORMING A CONVERGENT LENS IN A PLATE OF TRANSPARENT MINERAL MATERIAL

[75] Inventor: Claude-Michel Juvet, Fleurier, Switzerland

[73] Assignee: Comadur SA, La Chaux-de-Fonds, Switzerland

[21] Appl. No.: 595,899

[22] Filed: Apr. 2, 1984

[30] Foreign Application Priority Data

Mar. 31, 1983 [CH] Switzerland ..... 1800/83

[51] Int. Cl.[4] ..... B24B 1/00

[52] U.S. Cl. ..... 51/284 R; 51/124 L

[58] Field of Search ..... 51/284 R, 124 L

[56] References Cited

U.S. PATENT DOCUMENTS

| | | | |
|---|---|---|---|
| 1,491,383 | 4/1924 | Dey | 51/284 R |
| 1,515,681 | 11/1924 | Hill | 51/284 R |
| 1,563,918 | 12/1925 | Parsons | 51/284 R |
| 2,336,322 | 12/1943 | Uhlemann | 51/284 R |
| 2,747,339 | 5/1956 | Schelling | 51/124 L |
| 2,975,565 | 3/1961 | Phillips | 51/124 L |
| 2,977,724 | 4/1961 | Kennedy et al. | 51/124 L |
| 4,494,338 | 1/1985 | Nagaura | 51/284 R |

FOREIGN PATENT DOCUMENTS

| | | | |
|---|---|---|---|
| 977720 | 11/1950 | France | 51/124 L |
| 449398 | 6/1936 | United Kingdom | 51/284 R |
| 865619 | 9/1981 | U.S.S.R. | 51/284 R |

*Primary Examiner*—Frederick R. Schmidt
*Assistant Examiner*—J. T. Zatarga
*Attorney, Agent, or Firm*—Pollock, Vande Sande & Priddy

[57] ABSTRACT

A method is described of forming a circular convergent lens in a plate of transparent mineral material, which involves grinding the lens with a grinding member having a lesser diameter than the lens and imparting an oscillatory motion to the plate relatively to the grinding wheel.

This method also enables self-dressing of the grinding member.

11 Claims, 7 Drawing Figures

METHOD OF FORMING A CONVERGENT LENS IN A PLATE OF TRANSPARENT MINERAL MATERIAL

BACKGROUND OF THE INVENTION

1. Field of the Invention

This invention relates to a method of forming a circular convergent lens in a plate of transparent mineral material.

2. Prior Art

Watch glasses are often provided with a convergent lens to facilitate the reading of a watch calendar. When the watch glass is of mineral material, the lens is glued to the surface of the glass. This, however, is unsightly, nor can unsticking of the lens be completely avoided. When the watch glass is of organic material, the lens can be embedded within the thickness of the glass. Unfortunately, this type of material is softer and therefore more subject to scratching than mineral materials, such as sapphire, which provide the watch glass with an excellent resistance to abrasion.

SUMMARY OF THE INVENTION

A main object of the invention is to enable plates of transparent mineral material to be provided with a circular convergent lens, involving no added thickness and no risk of unsticking.

To this end, the lens is formed by grinding the plate, but the grinding is not carried out with a grinding member having the same diameter and the same radius of curvature as the lens, as this would cause the outer part of the grinding member to wear more rapidly than its central part.

According to the invention there is provided a method of forming a circular convergent lens in a plate of transparent mineral material, comprising simultaneously:

rotating said plate about a first axis which is perpendicular to the region where the lens is to be formed and which extends through the center of said region;

grinding said region with a rotating grinding member having a circular operative portion which is of lesser diameter than the lens and which rotates about a second axis contained in a plane containing said first axis; and oscillating said plate or said grinding member about a third axis perpendicular to the plane containing said first and second axes, intersecting said first axis and located at a distance from said region equal to the radius of curvature required for said lens.

Surprisingly, it has been found that if a grinding member is used whose operative portion has a diameter smaller than that of the lens and if the plate is made to oscillate with respect to the grinding member, the time interval between two dressings of the grinding member is substantially increased.

When the arc encompassed by the operative portion of the grinding member exceeds half the arc of the lens, the only function of the oscillatory motion is to provide self-dressing of the grinding member. If however the arc encompassed by the operative portion of the grinding member is smaller than half the arc of the lens, the rotary motion of the plate is not sufficient to ensure the machining of the whole surface of the lens. For such machining to be possible, the angle of oscillation must be at least equal to the angle corresponding to the difference between half the arc of the lens and the arc encompassed by the operative portion of the grinding member.

DESCRIPTION OF BEST MODE AND OTHER EMBODIMENTS

Figure 1:
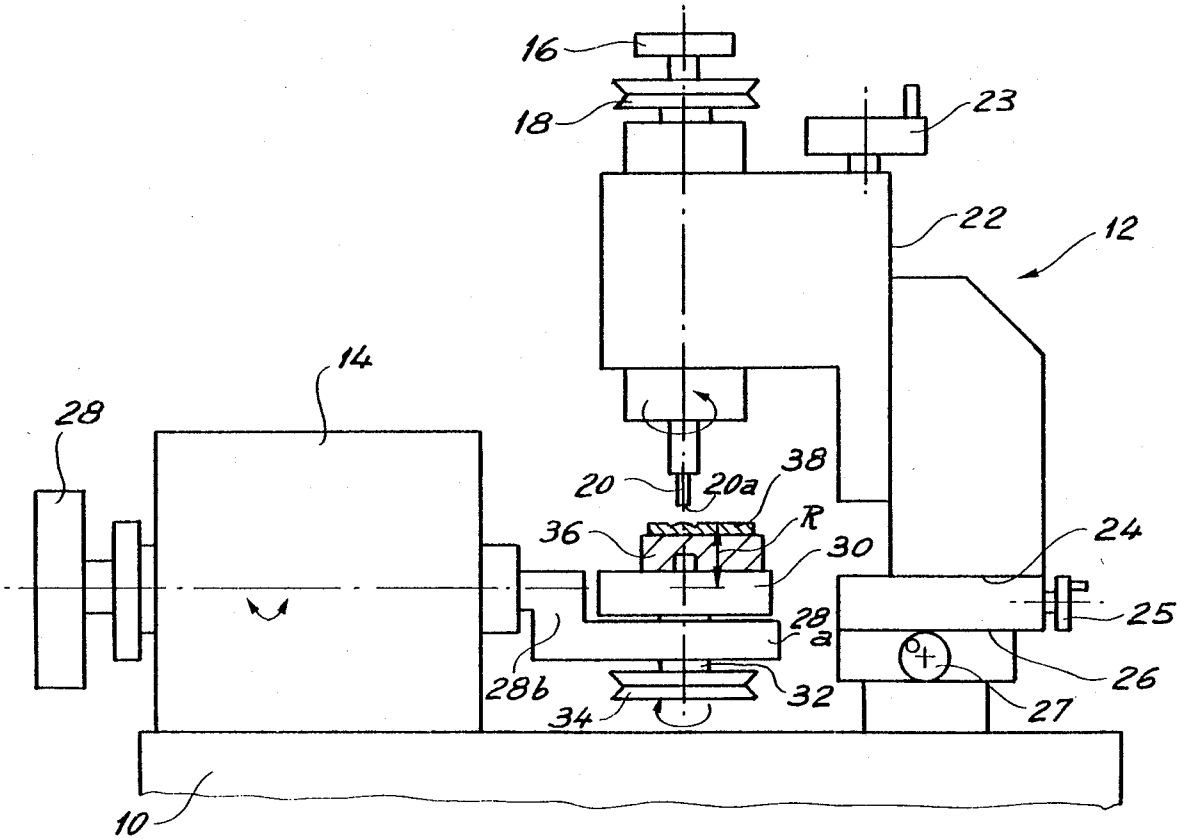
FIG. 1 shows one form of apparatus for carrying out the method according to the invention.

The apparatus shown in FIG. 1 comprises a bed 10 on which are mounted a knee-type column 12 and a head-stock 14. Column 12 holds a spindle 16 to the end of which is fitted a cylindrical grinding rod 20 coaxial with the spindle and provided at its operative tip 20*a* with abrasive material, preferably diamond dust. A motor, not shown, drives the spindle 16 via a pulley 18 keyed thereon. Column 12 further comprises slide-ways 22, 24 and 26 which enable the grinding rod 20 to be moved, in conventional manner, along three orthogonal axes. In particular, slide-way 22 enables the vertical positioning of the grinding rod by means of a micrometric screw 23, while slide-ways 24 and 26 enable the horizontal positioning of the grinding rod along two perpendicular axes by means of micrometric screws 25 and 27 respectively.

Head-stock 14 has a shaft 28 whose end portion 28*a*, nearest to column 12, is offset downwardly with respect to the rotational axis of the shaft by means of a crank 28*b*. A table 30 is carried by a shaft 32 which is perpendicular to the axis of shaft 28 and which is rotatably mounted in end portion 28*a*. A motor, not shown, drives shaft 32 via a pulley 34 keyed thereon. A prop 36, secured to table 30, enables a plate 38 of transparent mineral material, such as a watch-glass, to be held in place in order to be provided with a lens.

Grinding rod 20 and prop 36 rotate in opposite directions.

The thickness of prop 36 is so chosen that the distance between the upper surface of plate 38 and the rotational axis of shaft 28 is equal to the radius of curvature R required for the lens.

Shaft 28 is connected to drive means, not shown, arranged to transmit thereto an oscillating motion of low amplitude.

Figure 2A:
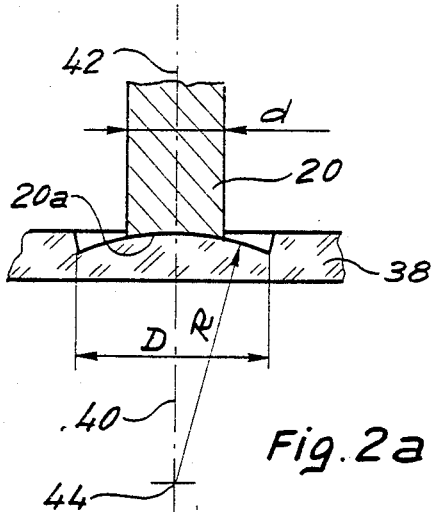
FIGS. 2*a*–2*b*, 3*a*–3*b* and 4*a*–4*b* illustrate, in vertical cross-section, three different arrangements for a part of the apparatus shown in FIG. 1.
Figure 2B:
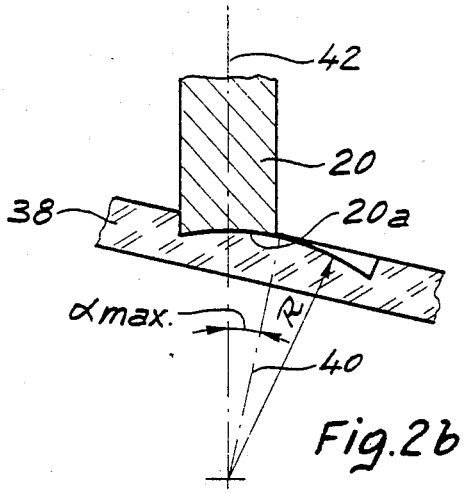

In a first arrangement shown in FIGS. 2*a* and 2*b*, the operative tip 20*a* of the grinding rod defines a round concave surface having a radius equal to the radius of curvature of the lens. When plate 38 is horizontal as in FIG. 2*a*, the axis 40 of shaft 32 and the axis 42 of spindle 16 coincide. In other positions of plate 38, these two axes both intersect the rotational axis of shaft 28, shown as 44, and form between them an angle $\alpha$ whose maximum value $\alpha_{max}$ is defined by the extreme positions of the plate.

The oscillating motion of shaft 28 enables the time interval between two dressings of the grinding wheel to be increased. This oscillating motion is made possible by the fact that the diameter D of the lens is substantially greater than the diameter d of the grinding rod. Preferably, the ratio d/D ranges from $\frac{1}{3}$ to $\frac{2}{3}$. The relationship between the angle $\alpha_{max}$, diameters D and d and the radius of curvature R is expressed by the following formula:

$$\tan \alpha_{max} = \frac{2R(D-d)}{4R^2 + D \times d}$$

This relationship defines the maximum amplitude the oscillating motion of shaft 28 must have for a grinding rod of specific diameter to produce a lens of required diameter and required radius of curvature. With a radius of curvature R having a magnitude between once and twice that of lens diameter D, and with a ratio d/D between $\frac{1}{3}$ and $\frac{2}{3}$, the angle $\alpha_{max}$ ranges from 5° to 20° approximately.

Practice has shown that the greater the amplitude of oscillation, the better the self-dressing of the grinding rod becomes, for a given diameter of the rod. In the arrangement of FIGS. 2*a* and 2*b*, this maximum amplitude corresponds to an oscillation such that $\alpha$ varies from $+\alpha_{max}$ to $-\alpha_{max}$. When the arc described by the operative tip of the grinding rod is less than half the arc of the lens, the oscillation must have an amplitude lying between $\alpha_{max}$ and $\alpha_{min}$, $\alpha_{min}$ being the minimum amplitude and being equal to $\alpha_{max}$ minus the difference between the angle defined by half the arc of the lens and the angle defined by the arc formed by the operative tip of the grinding rod.

Figure 3A:
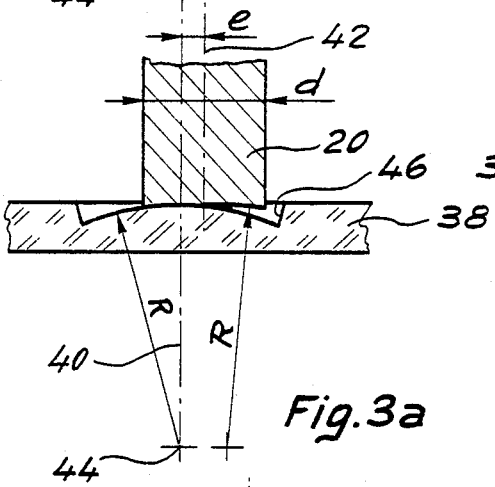
Figure 3B:
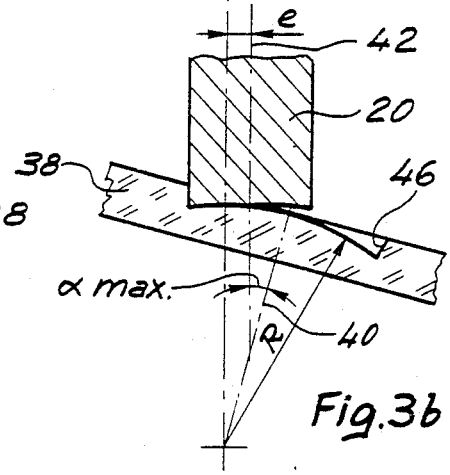

In a second arrangement shown in FIGS. 3*a* and 3*b*, axes 40 and 42 of shaft 32 and spindle 16 respectively together define a plane which coincides with the plane of the Figures and is perpendicular to the axis 44 of shaft 28. Axis 42 is at a distance e from axis 44. When plate 38 is horizontal (FIG. 3*a*), axes 40 and 42 are parallel. In other positions, the two axes form an angle $\alpha$ whose maximum value $\alpha_{max}$ is reached when shaft 28 is at the peak of its oscillation (FIG. 3*b*). This oscillation can only take place in one direction, from the horizontal position towards an inclined position wherein the edge portion of the lens remote from axis 42 moves up (FIG. 3*b*). A rocking action in the opposite direction would cause the grinding rod 20 to abut against a peripheral frusto-conical surface 46 between the edge of the lens and the flat surface of plate 38, thereby damaging the grinding rod and spooling the surface 46. In this arrangement, the relationship between the different parameters is defined by the following formula:

$$\tan \alpha_{max} = \frac{2R(D-d+e)}{4R^2 + D(d-e)}$$

The value of (d-e) normally ranges from D/3 to 2D/3, which means that the value of $\alpha_{max}$ here also ranges from 5° to 20°.

The greater the distance e, the greater the diameter of the grinding rod, but if this diameter is too large the shape of surface 46 (FIGS. 3*a* and 3*b*) surrounding the lens becomes deformed, widening outwards, thus causing the product to become less attractive.

This drawback can be avoided if the diameter d of the grinding rod, the diameter D of the lens and the angle $\alpha_{max}$ fit the inequality:

$$D \cos \alpha_{max} \geqq d.$$

The shape of the surface of the grinding rod tip 20*a* is, in this case, that of a fringe portion of a hollow torus in which the radius of its generating circle is equal to the radius of curvature R of the lens and in which the distance between its generating axis and the center of its generating circle is equal to e. In so doing, a grinding rod of greater diameter can be used, thus increasing its lifetime, as it is subjected to less wear and tear. The adjustment of the mechanism is however more difficult.

The rules concerning the minimum amplitude of oscillation also apply to this arrangement except that with a diameter of the same size, the arc described by the operative tip of the grinding rod is about half the corresponding arc in the first arrangement, due to the fact that the operative tip has the shape of part of a torus instead of that of part of a sphere.

Figure 4A:
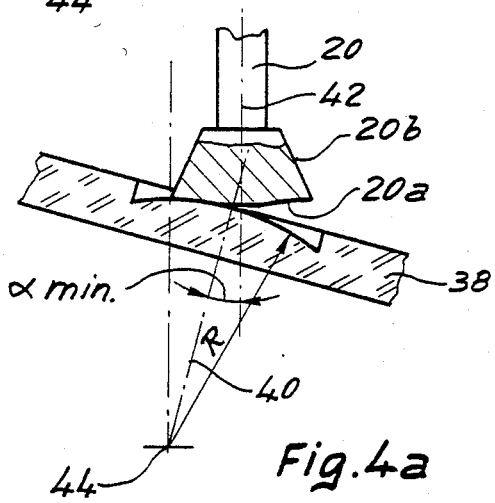
Figure 4B:
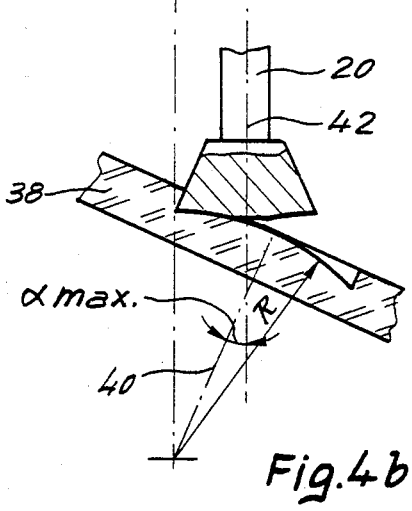

The arrangement shown in FIGS. 4*a* and 4*b* is similar to that in FIGS. 3*a* and 3*b* with an angle $\alpha$ which is never zero. These operating conditions are obtained by causing shaft 28 to oscillate between two extreme positions in which axes 40 and 42 form an angle $\alpha_{min}$ (FIG. 4*a*), to ensure that the grinding rod engages the central region of the lens, and an angle $\alpha_{max}$ (FIG. 4*b*), to ensure that the grinding rod engages the outer region of the lens.

If in this case a grinding rod is used similar to that in FIGS. 3*a* and 3*b*, a peripheral frusto-conical surface would ensue between the edge of the lens and the flat surface of plate 38, having a wide angle and the result would be unattractive. This drawback can be avoided by resorting to a grinding member having an operative tip 20*a*, shaped as part of a torus, which is connected to a stem by a frusto-conical portion 20*b* having at its apex an angle of $2\alpha_{max}$. In this case, portions 20*a* and 20*b* can be machined independently from the stem of the grinding member, then fitted to the latter by conventional means. Because angle $\alpha_{max}$ is relatively large, the central region of the operative tip 20*a* shaped as a fringe part of a hollow torus protrudes and can therefore readily be truncated to provide access to assembly means, not shown.

In all three arrangements described with reference to FIGS. 2*a* to 4*b*, the oscillating motion is applied to the table bearing the plate. The same effect is obtained if the grinding member oscillates about axis 44.

Mechanical tests carried out on plates in which lenses have been formed as described have shown that, with a sapphire thickness of 0.6 mm and for a lens thickness of 0.2 mm, the mechanical resistance of the plate is in no way affected.

This method performed by the above described apparatus is well suited to the machining of sapphire plates, but also to that of other materials, e.g. mineral glass.

What is claimed is:

1. A method of forming a circular convergent lens in a plate of transparent mineral material, comprising simultaneously:

rotating said plate about a first axis which is perpendicular to the region where the lens is to be formed and which extends through the center of said region;

grinding said region with a rotating grinding member having a circular operative portion which is of lesser diameter than the lens and which rotates about a second axis contained in a plane containing said first axis; and, oscillating said plate or said grinding member round a third axis perpendicular to the plane containing said first and second axes, intersecting said first axis and located at a distance from said region equal to the radius of curvature required for said lens;

said second and third axes being spaced a constant distance apart from each other, said operative portion of the grinding member having a concave grinding surface shaped as a fringe portion of a hollow torus whose generating axis coincides with said second axis and whose generating circle has a radius equal to the radius of curvature of the lens, and the distance between said generating axis and the center of said generating circle being equal to the distance between said second and third axes.

2. A method as in claim 1, wherein the operative portion member has a diameter d, the lens has a diameter D and said first and second axes form a maximum angle $\alpha_{max}$ which fit the inequality: $D \cos \alpha_{max} \geqq d$.

3. A method as in claim 2, wherein said grinding member has a cylindrical stem portion and, between the stem portion and said operative portion, a frusto-conical portion whose narrow end is adjacent said stem portion and whose apex forms an angle of $2\alpha_{max}$.

4. An apparatus for forming a circular convergent lens in a region within a plate of transparent mineral material, said apparatus comprising:

means for rotating said plate about a first axis which is perpendicular to said region where said lens is to be formed and which extends through the center of said region;

means for rotating a grinding member having a circular operative portion for grinding said region, said operative portion being of a lesser diameter than said lens, rotating about a second axis contained in a plane containing said first axis, and having a concave grinding surface shaped as a fringe portion of a hollow torus whose generating axis coincides with said second axis and whose generating circle has a radius equal to the radius of curvature of said lens; and, means for oscillating said plate or said grinding member around a third axis which is perpendicular to the plane containing said first and second axes, which intersects said first axis and which is located at a distance from said region equal to the radius of curvature required for said lens, said second and third axes being spaced a constant distance apart from each other and the distance between the generating axis and the center of the generating circle of said hollow torus being equal to the distance between said second and third axes.

5. The apparatus of claim 4 in which said operative portion has a diameter d, the lens has a diameter D and said first and second axes form a maximum angle $\alpha_{max}$ which fit the inequality: $D \cos \alpha_{max} \geqq d$.

6. The apparatus of claim 5 in which said grinding member has a cylindrical stem portion and, between the stem portion and said operative portion, a frusto-conical portion whose narrow end is adjacent said stem portion and whose apex forms an angle of $2\alpha_{max}$.

7. The apparatus of claim 4 in which said concave grinding surface is smaller than half the arc of said lens, and the angle of oscillation round said third axis is at least equal to the angle corresponding to the difference between half the arc of said lens and the arc encompassed by said concave grinding surface.

8. The apparatus of claim 4 which includes means for rotating said plate and said grinding member in opposite directions.

9. The apparatus of claim 4 in which said oscillation round said third axis takes place between a horizontal position and an inclined position in only one direction relative to said horizontal position.

10. The apparatus of claim 4 in which the angle between said first and second axes is never zero.

11. The apparatus of claim 4 in which the operative portion of said grinding member has a central region which protrudes and is truncated so as to provide access for an assembly means.

* * * * *